US010907876B2

(12) United States Patent
Inamori et al.

(10) Patent No.: US 10,907,876 B2
(45) Date of Patent: Feb. 2, 2021

(54) FLOW-TYPE ICE MAKER

(71) Applicant: OXEN, INC., Aichi (JP)

(72) Inventors: Reijiro Inamori, Aichi (JP); Soichiro Inamori, Aichi (JP)

(73) Assignee: OXEN, INC., Aichi (JP)

( * ) Notice: Subject to any disclaimer, the term of this patent is extended or adjusted under 35 U.S.C. 154(b) by 7 days.

(21) Appl. No.: 16/194,661

(22) Filed: Nov. 19, 2018

(65) Prior Publication Data

US 2019/0316823 A1 Oct. 17, 2019

(30) Foreign Application Priority Data

Apr. 13, 2018 (JP) ..... 2018-078037

(51) Int. Cl.

| | |
|---|---|
| ***F25C 5/10*** | (2006.01) |
| ***F25C 5/182*** | (2018.01) |
| ***F25C 1/10*** | (2006.01) |
| ***F25C 1/25*** | (2018.01) |

(52) U.S. Cl.

CPC ..... *F25C 5/10* (2013.01); *F25C 1/10* (2013.01); *F25C 1/25* (2018.01); *F25C 5/182* (2013.01)

(58) Field of Classification Search

CPC .... F25C 5/10; F25C 5/182; F25C 5/02; F25C 5/04; F25C 1/25; F25C 1/08; F25C 1/10; F25C 1/12; F28D 1/047; F28D 1/0477

See application file for complete search history.

(56) References Cited

U.S. PATENT DOCUMENTS

| | | | | |
|---|---|---|---|---|
| 5,438,839 | A * | 8/1995 | Wardle | A23L 3/361 62/345 |
| 2014/0182314 | A1* | 7/2014 | Hoti | F25C 1/12 62/71 |
| 2015/0136361 | A1* | 5/2015 | Gregory | F24D 3/148 165/104.19 |

FOREIGN PATENT DOCUMENTS

| | | | |
|---|---|---|---|
| JP | 1991121365 | U | 12/1999 |
| JP | 2004125385 | A | 4/2004 |
| JP | 2015135217 | A | 7/2015 |
| JP | 2018039043 | A | 3/2018 |
| WO | 2014/105838 | A | 7/2014 |

* cited by examiner

*Primary Examiner* — Joseph F Trpisovsky
(74) *Attorney, Agent, or Firm* — Norris McLaughlin, P.A.

(57) ABSTRACT

A flow-type ice maker including substrate, an ice-making part configured by a refrigerant pipe connected to a refrigerator and through which a refrigerant circulates in an airtight manner, an ice-making rack supporting the refrigerant pipe and including an ice mold formed along an outer periphery of the refrigerant pipe, an ice-making water flow part joined to an upper part of the ice-making rack and allowing ice-making water to flow into the ice-making rack, and an ice-separating member to rotating around a direction parallel to the axis center of the refrigerant pipe to separate ice formed in the ice mold, and an ice-making water feed pipe feeding ice-making water to the ice-making water flow part. The refrigerant pipe has a curved part; and an outer periphery of a pipe made of any one of copper and aluminum is covered with stainless steel.

5 Claims, 6 Drawing Sheets

[Fig. 6]
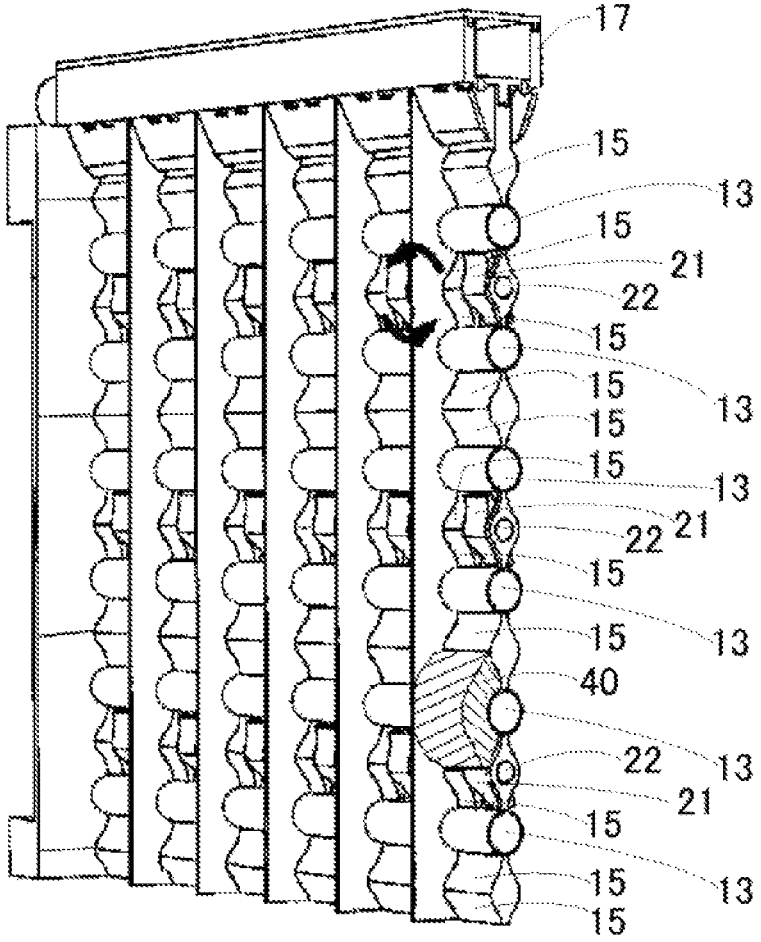
[Fig. 7]
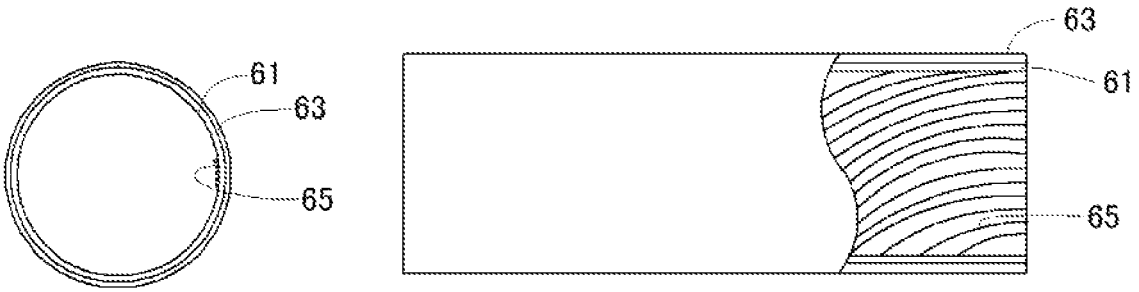
7(a) 7(b)

FLOW-TYPE ICE MAKER

BACKGROUND

Technical Field

The present invention relates to a flow-type ice maker that makes ice in an ice-making rack by allowing ice-making water to flow into the ice-making rack. The invention particularly relates to a structure of a refrigerant pipe of the ice maker.

Related Art

A flow-type ice maker is a device that makes ice by allowing ice-making water to flow continuously into an ice-making rack. For example, a device described in WO 2014/105838 filed by the present applicant has been known. This device makes ice on a surface including the outer periphery of a refrigerant pipe, by allowing ice-making water to continuously flow into an ice-making rack supporting the refrigerant pipe. Since this device makes ice directly on the outer periphery of the refrigerant pipe, it has high heat-exchange efficiency.

In a conventional ice maker, a tinned copper pipe is used as a refrigerant pipe. Although this refrigerant pipe has high heat-exchange efficiency, it has a problem that the tin plating easily comes off to expose the copper. Since the refrigerant pipe needs to be replaced when copper is exposed at a contact point with ice, maintenance of the ice maker has required time and effort.

An objective of the present invention is to provide a flow-type ice maker including a refrigerant pipe whose contact surface with ice is kept unaffected over a long period of time, and that has high thermal conductivity. Another objective is to provide a flow-type ice maker that can reduce the radius of curvature of a curved part of the refrigerant pipe.

SUMMARY

The present inventors have found that the above problem can be solved by covering the outer periphery of a pipe made of copper or aluminum with stainless steel, and using the pipe as a refrigerant pipe of a flow-type ice maker. The inventors also have found that high heat-exchange efficiency can be achieved by forming a groove on a pipe inner part of the refrigerant pipe. The present invention has been completed according to the above knowledge.

The present invention that solves the above problem will be described below.

[1] A flow-type ice maker including:

an ice-making part configured by a refrigerant pipe connected to a refrigerator and through which a refrigerant circulates in an airtight manner, an ice-making rack supporting the refrigerant pipe and including an ice mold formed along an outer periphery of the refrigerant pipe, an ice-making water flow part joined to an upper part of the ice-making rack and allowing ice-making water to flow into the ice-making rack, and an ice-separating member rotating around a direction parallel to the axis center of the refrigerant pipe to separate ice formed in the ice mold; and an ice-making water feed pipe feeding ice-making water to the ice-making water flow part, wherein:

the refrigerant pipe has a curved part; and an outer periphery of a pipe made of any one of copper and aluminum is covered with stainless steel.

[2] The flow-type ice maker described in [1], in which the refrigerant pipe of the curved part has an radius of curvature that is twice to ten times the pipe outer diameter of the refrigerant pipe.

[3] The flow-type ice maker described in [1], in which the refrigerant pipe has a pipe outer diameter of 8 to 20 mm.

[4] The flow-type ice maker described in [1], in which in the refrigerant pipe, a ratio of a thickness of the pipe made of any one of copper and aluminum to a thickness of the pipe made of stainless steel is 1:0.2 to 1:2.

[5] The flow-type ice maker described in [1], in which the refrigerant pipe is a refrigerant pipe having a groove formed on a pipe inner wall.

[6] The flow-type ice maker described in [5], in which the groove formed in the refrigerant pipe is a plurality of helical grooves.

In the flow-type ice maker of the present invention, the refrigerant pipe is formed by covering the outer periphery of a pipe made of copper or aluminum with stainless steel. Hence, the contact surface with ice is less likely to deform even after use for a long period of time. Accordingly, the ice maker can be maintained easily. Moreover, since the outer periphery of a pipe made of copper or aluminum is covered with stainless steel, bending is made easier, and the radius of curvature of the curved part can be reduced. Hence, the ice maker can be reduced in size. Additionally, by forming a groove in the pipe inner wall of the refrigerant pipe, occurrence of a laminar flow on the pipe wall part can be suppressed, and heat-exchange efficiency can be enhanced. In the flow-type ice maker of the present invention, the outer peripheral surface of the refrigerant pipe is configured by stainless steel, whereas the pipe inner part is configured by copper or aluminum. Hence, the groove can be formed easily.

BRIEF DESCRIPTION OF DRAWINGS

FIG. 3A is a plan view of an ice-making cell 11*a*, while

FIG. 6 is an explanatory drawing of a structure of the ice-making part 10; and FIG. 7A is a schematic diagram of a cross section perpendicular to the pipe axis of the refrigerant pipe, and FIG. 7B is a schematic diagram of the internal structure of the refrigerant pipe.

DETAILED DESCRIPTION

Hereinafter, an example of the present invention will be described in detail, with reference to the drawings.

Figure 1:
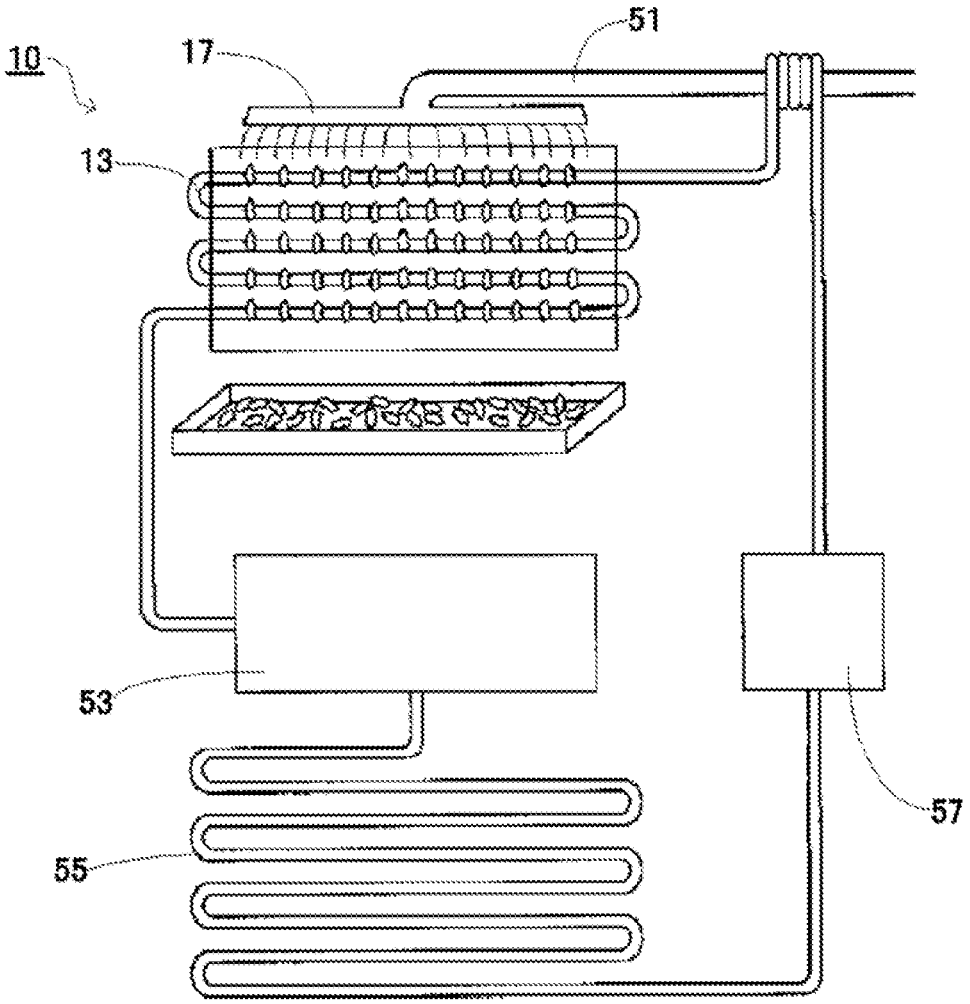
FIG. 1 is an explanatory drawing of a structure of a flow-type ice maker of the present invention.

FIG. 1 is an explanatory drawing of a structure of a flow-type ice maker of the present invention. In FIG. 1, reference numeral 10 denotes an ice-making part. The ice-making part 10 is configured by a refrigerant pipe 13 through which a refrigerant flows in an airtight manner, an ice-making rack (omitted from FIG. 1 to describe internal structure) supported by the refrigerant pipe 13 and including an ice mold, an ice-separating member (not shown) that separates and drops ice formed in the ice mold, and an ice-making water flow part 17 that supplies ice-making water to the refrigerant pipe 13. An ice-making water feed pipe 51 is connected to the ice-making water flow part 17. A refrigerating cycle is formed by connecting the refrigerant pipe 13 to a compressor 53, a condenser 55, and an evaporator 57 installed outside the ice-making part 10.

Figure 2:
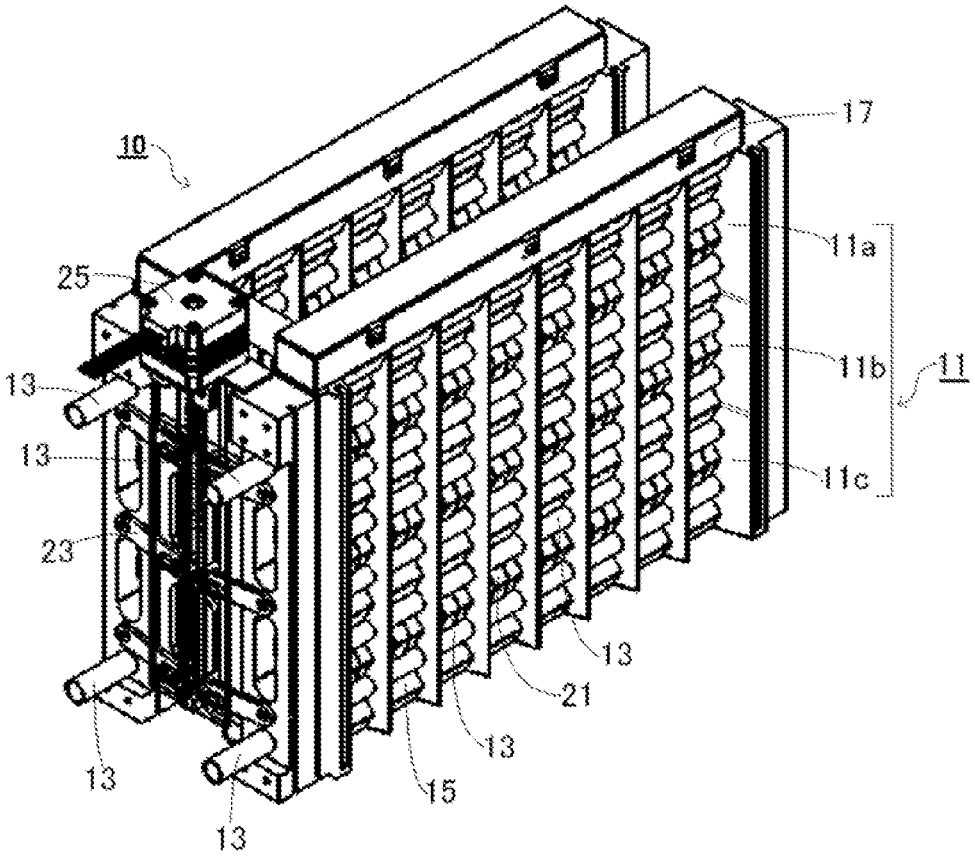
FIG. 2 is a perspective view of a structure of an ice-making part 10.

FIG. 2 is a perspective view of a structure of the ice-making part 10 of the flow-type ice maker of the present invention. Reference numeral 11 denotes an ice-making rack, which is supported by the refrigerant pipe 13 having a plurality of curved parts (four curved parts in FIG. 1). An ice mold 15 is formed in an outer peripheral part of the refrigerant pipe 13. An ice-separating member 21 is fitted into the ice-making rack 11. The ice-separating member 21 is connected to an arm 23 that is driven by a motor 25. An ice-making water flow part 17 is joined to an upper part of the ice-making rack 11. In the present invention, the ice-making rack 11 is formed by connecting a plurality of ice-making cells 11*a*, 11*b*, 11*c*.

Figure 3A:
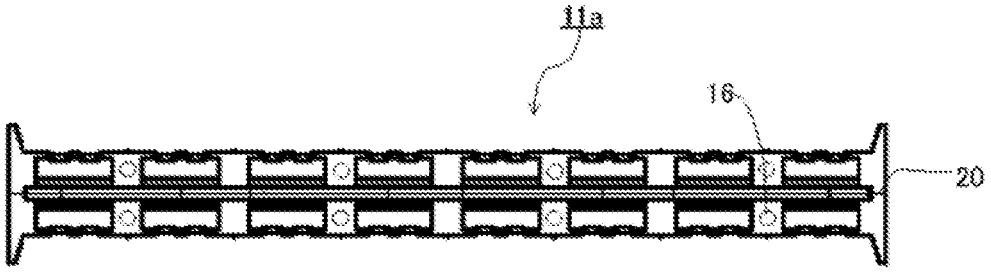
Figure 3B:
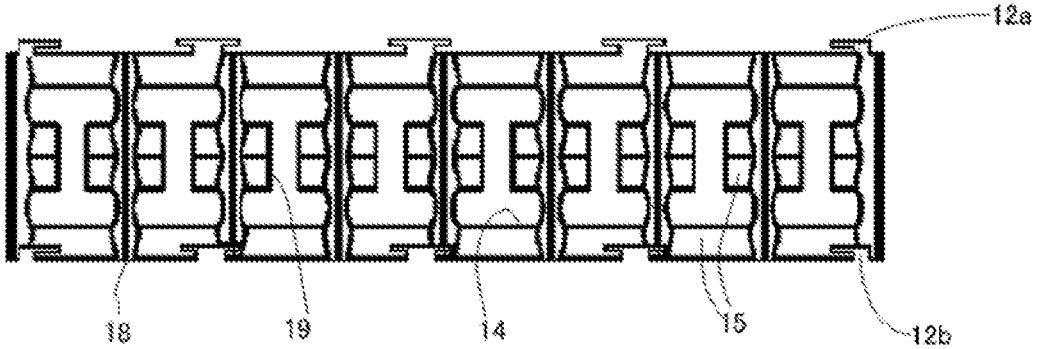
FIG. 3B is a front view of the ice-making cell 11*a;*

FIG. 3A is a plan view of the ice-making cell 11*a*, and FIG. 3B is a front view of the ice-making cell 11*a*. A plurality of partition walls 18 is formed in the ice-making cell 11*a*, and the partition walls 18 partition the inside of the ice-making cell (partitioned into eight parts in FIG. 3B). A refrigerant pipe supporting part 14 for supporting the refrigerant pipe 13 is formed in the ice-making cell 11*a*. The ice mold 15 is formed along the refrigerant pipe supporting part 14 in the ice-making cell 11*a*. The ice mold 15 is partially cut out to form an ice-separating member fitting part 19 into which the ice-separating member 21 fits.

Connection members 12*a* and 12*b* for connecting a plurality of ice-making cells are formed in the ice-making cell 11*a*. The plurality of ice-making cells is connected by the connection members.

Figure 4:
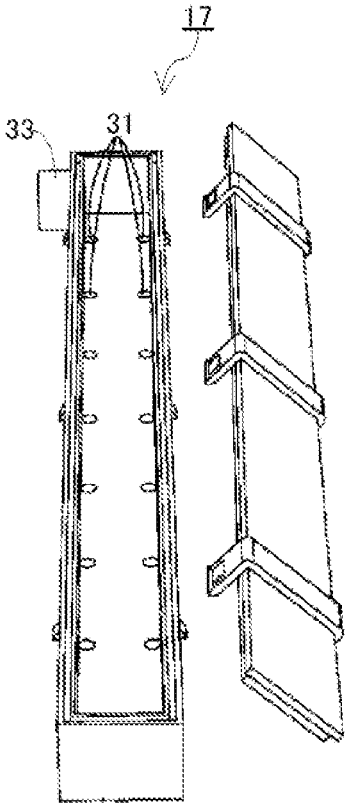
FIG. 4 is an explanatory drawing of a structure of an ice-making water flow part 17.

FIG. 4 is an explanatory drawing of a structure of the ice-making water flow part 17. A plurality of holes 31 is formed in a bottom face of the box-shaped ice-making water flow part 17 including an ice-making water feed pipe connection port 33. Ice-making water fed from the ice-making water feed pipe connection port 33 flows into the ice-making rack 11 through the holes 31.

Figure 5:
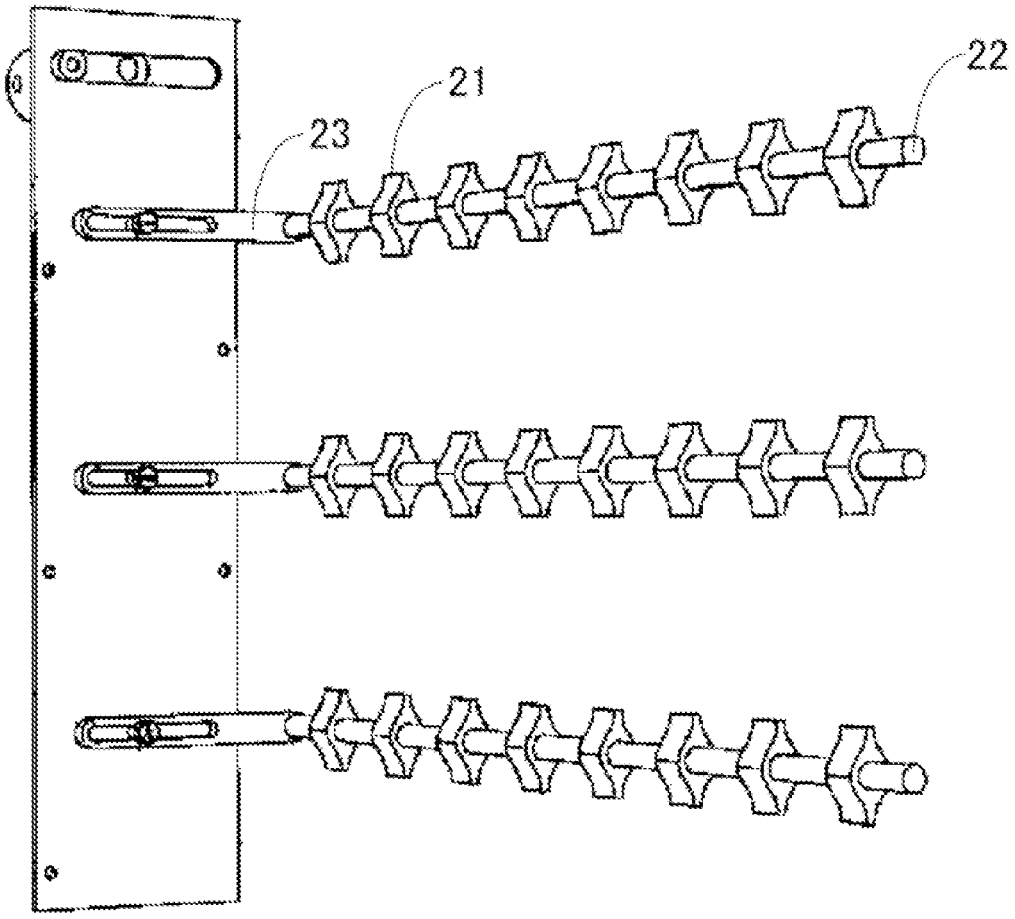
FIG. 5 is an explanatory drawing of a structure of an ice-separating member 21.

FIG. 5 is an explanatory drawing of a structure of the ice-separating member 21. The ice-separating member 21 is fixed to a rotary shaft 22, and the rotary shaft 22 is connected to the arm 23 driven by a motor. When the arm 23 is driven by the motor, the ice-separating member 21 rotates around a direction parallel to the axis center of the refrigerant pipe 13. Thus, ice formed in the ice mold can be separated and dropped.

FIG. 6 is an explanatory drawing of a structure of the ice-making part 10. Operation of the flow-type ice maker of the present invention will be described with reference to FIG. 6.

First, ice-making water is fed into the box of the ice-making water flow part 17. The fed ice-making water flows into the ice-making rack 11 through the holes 31. A part of ice-making water that has flowed into the ice-making rack 11 comes into contact with an outer peripheral part of the refrigerant pipe 13 through which a refrigerant circulates, and freezes. The rest of the ice-making water flows into lower refrigerant pipes. Accordingly, ice is formed along the shape of the ice mold 15, in the outer peripheral part of the refrigerant pipe 13. In FIG. 6, reference numeral 40 denotes ice formed in the ice-making rack 11. Although ice is formed in all of the ice mold 15 parts formed in the ice-making rack 11, FIG. 6 shows only one piece of ice. When ice formed in the outer peripheral part of the refrigerant pipe 13 grows into a predetermined size, circulation of the refrigerant inside the refrigerant pipe 13 is blocked, and if necessary, hot gas is circulated inside the refrigerant pipe 13 to melt a part of ice attached to an outer peripheral wall of the refrigerant pipe 13. Thereafter, the ice-separating member 21 is rotated around a direction parallel to the axis center of the refrigerant pipe 13 as indicated by arrows in FIG. 6. This separates and drops ice from the ice mold 15. The dropped pieces of ice are stocked below the ice-making rack 11 to be used (see FIG. 1).

The ice-making rack 11 is formed of a resin material. The resin material is not particularly limited, as long as it is a resin that complies with the Food Sanitation Law. Examples of the resin include polyacetal (POM), polycarbonate (PC), ethylene bis stearamide (EBS), and polypropylene (PP).

The refrigerant pipe 13 is a pipe having a circular or oval cross section, and is formed by covering the outer periphery of a pipe made of copper or aluminum with stainless steel. FIG. 7A is a schematic diagram of a cross section perpendicular to the pipe axis of the refrigerant pipe, and FIG. 7B is a schematic diagram of the internal structure of the refrigerant pipe. Reference numeral 61 denotes an inside part of the refrigerant pipe, and reference numeral 63 denotes an outside part of the refrigerant pipe. Reference numeral 65 denotes a later-mentioned groove, which is preferably formed at regular intervals in a pipe inner peripheral part. Although only a part of the groove 65 is shown and the rest is omitted in FIG. 7A, originally, it is preferable that the groove 65 is formed over the entire inner wall of the refrigerant pipe.

The refrigerant pipe 13 is formed such that ice-making water comes into direct contact with the metal surface of the refrigerant pipe 13. That is, since the refrigerant pipe 13 is not covered with resin or the like, the refrigerant pipe 13 has high heat-exchange efficiency. Moreover, since the resin material (ice-making rack) and the metal material (refrigerant pipe 13) are combined, ice is held securely in the ice-making rack at the time of ice making, and the ice is separated easily at the time of separation from the mold. Ice made by the ice maker of the present invention is preferably in contact with the ice-making rack (resin part) and the refrigerant pipe (metal part) at a rate of 1:0.1 to 1:10, and is more preferably in contact therewith at the rate of 1:0.5 to 1:2. Since the ice is held by being in contact with the parts at this rate, both high heat-exchange efficiency and separability can be achieved.

The ice maker of the present invention is characterized by using, as the refrigerant pipe 13, a pipe formed by covering the outer periphery of a pipe made of copper or aluminum with stainless steel. The refrigerant pipe is preferably a pipe formed by covering the outer periphery of a pipe made of copper with stainless steel.

The pipe outer diameter of the refrigerant pipe is preferably 8 to 20 mm, and is more preferably 10 to 18 mm.

Additionally, in the refrigerant pipe used in the present invention, the ratio of the thickness of a pipe (inside part) made of copper or aluminum to the thickness of a pipe (outside part) made of stainless steel is preferably 1:0.2 to 1:2, and is more preferably 1:0.8 to 1:1.7. When the thickness of the outside part is smaller than 0.2 times the thickness or exceeds twice the thickness of the inside part, the outside part is likely to crack. The crack is likely to occur particularly during bending. Moreover, even if the refrigerant pipe can be bent, since the refrigerant pipe circulates a low-temperature refrigerant when ice is made, and circulates hot gas when the ice is melted, a crack may occur due to heat shock. Furthermore, when the thickness of the outside part exceeds twice the thickness of the inside part, heat-exchange efficiency deteriorates.

More specifically, the thickness of the inside part is preferably 0.2 to 0.8 mm. The thickness of the outside part is preferably 0.1 to 0.8 mm.

The refrigerant pipe 13 has a plurality of curved parts. A radius of curvature of the curved part of the refrigerant pipe is preferably 2 to 10 cm. The radius of curvature of the curved part is preferably twice to five times the pipe outer diameter of the refrigerant pipe, and is more preferably three to four times the pipe outer diameter of the refrigerant pipe. When the radius of curvature of the curved part exceeds five times the pipe outer diameter of the refrigerant pipe, the ice maker becomes large. When the radius of curvature of the curved part is less than twice the pipe outer diameter of the refrigerant pipe, the curved part of the refrigerant pipe is likely to crack.

Although the stainless steel is not particularly limited as long as it is suitable for use in food, in consideration of processability, SUS410, SUS430, SUS304, and SUS316 are preferably used.

Layers of such a two-layer refrigerant pipe 13 need to be brought into intimate contact with each other at the interface, to maintain heat-exchange efficiency. Hence, the refrigerant pipe 13 is preferably formed as one unit. That is, the pipe made of copper or aluminum and the pipe made of stainless steel are preferably in intimate contact with each other and integrated, with no gap or adhesive, for example, in between. Such a two-layer pipe can be produced in a similar manner as a conventionally available clad pipe.

It is preferable that a groove is formed on a pipe inner part of the refrigerant pipe 13. Such a groove can suppress deterioration in heat-exchange efficiency due to a laminar flow generated on a pipe inner wall part. Further, the groove increases the surface area of the pipe inner wall, and can thereby enhance heat-exchange efficiency even more. The groove is preferably formed into a helical shape. The helical groove is formed such that the lead angle relative to the pipe axis is preferably 5 to 45 degrees, and more preferably 10 to 30 degrees. Although the number of grooves is not particularly limited, it is preferable that 10 to 100 grooves are formed in the pipe inner peripheral part.

Although the depth of the groove is not particularly limited, the depth is preferably 0.03 to 0.6 mm, and more preferably 0.05 to 0.5 mm.

An ice-making water collection part that collects ice-making water flowing in from the ice-making rack 11 may be joined to a lower part of the ice-making rack 11.

The ice-making part 10 is placed in an ice-making room kept at a low temperature. The inside of the ice-making room may be cooled by circulating a refrigerant through the refrigerant pipe 13, or a separate cooling system may be provided.

EXAMPLE

Hereinafter, the present invention will be described in further detail by use of an example. This example indicates that the ice maker of the present invention has an equivalent ice-making capacity as an ice maker using a conventional refrigerant pipe.

Example 1

The device illustrated in FIGS. 1 and 2 was built. C3BR425L0Z of Kulthorn Kirby Public Co., Ltd was used as the compressor, and FWE-0.5T 9S of Fujikoki Corporation was used as the evaporator. As the refrigerant pipe, an integrally molded two-layer pipe including a 0.5 mm thick copper and a 0.5 mm thick stainless steel was used. On an inner wall of the refrigerant pipe, 60 grooves having a 16 degree lead angle were formed. The inner diameter of the refrigerant pipe was 10.7 mm. This device was used to make Ice continuously for a day. The average ice-making time, the average ice removal time (melt time), and the daily ice-making performance were measured. Note that the average ice-making time refers to the time required to make a total of 1.622 kg of ice in the entire ice-making rack, and the average ice removal time refers to the time required for all of the ice made in the ice-making rack to turn into a droppable state. As a result, the average ice-making time was 22 minutes 16 seconds, the average ice removal time was 2 minutes 00 seconds, and the daily performance was 96.3 kg. In this ice maker, no change was observed in the outer surface of the refrigerant pipe, even after repeated ice making.

Example 2

As the refrigerant pipe, a two-layer pipe including a 0.5 mm thick copper and a 0.3 mm thick stainless steel was used. On an inner wall of the refrigerant pipe, 60 grooves having a 13 degree lead angle were formed. An ice maker was built with other conditions being the same as Example 1. As a result, the average ice-making time was 22 minutes 38 seconds, the average ice removal time was 1 minute 42 seconds, and the daily performance was 106.1 kg. In this ice maker, no change was observed in the outer surface of the refrigerant pipe, even after repeated ice making.

Comparative Example 1

As the refrigerant pipe, a tinned pipe including a 1.0 mm thick copper was used. On an inner wall of the refrigerant pipe, 60 grooves having a 15 degree lead angle were formed. An ice maker was built with other conditions being the same as Example 1. As a result, the average ice-making time was 21 minutes 22 seconds, the average ice removal time was 1 minute 30 seconds, and the daily performance was 103.5 kg. After this refrigerant pipe was used for two years, the surface tin plating came off and exposed the internal copper, and the copper lost its metallic luster and turned brown.

What is claimed is:

1. A flow-type ice maker comprising:

an ice-making part configured by a refrigerant pipe connected to a refrigerator and through which a refrigerant circulates in an airtight manner, an ice-making rack supporting the refrigerant pipe and including an ice mold formed along an outer periphery of the refrigerant pipe, an ice-making water flow part joined to an upper part of the ice-making rack and allowing ice-making water to flow into the ice-making rack, and an ice-separating member rotates around a direction parallel to the axis center of the refrigerant pipe to separate ice formed in the ice mold; and an ice-making water feed pipe feeding ice-making water to the ice-making water flow part, wherein:

the refrigerant pipe has a curved part; and the refrigerant pipe comprises an outer periphery of a pipe made of any one of copper and aluminum is covered with stainless steel, wherein, in the refrigerant pipe, a ratio of a thickness of the pipe made of any one of copper and aluminum to a thickness of the pipe made of stainless steel is 1:0.2 to 1:2.

2. The flow-type ice maker according to claim 1, wherein the refrigerant pipe of the curved part has a radius of curvature that is twice to ten times the pipe outer diameter of the refrigerant pipe.

3. The flow-type ice maker according to claim 1, wherein the refrigerant pipe has a pipe outer diameter of 8 to 20 mm.

4. The flow-type ice maker according to claim 1, wherein the refrigerant pipe has a groove formed on the refrigerant pipe inner wall.

5. The flow-type ice maker according to claim 4, wherein the groove formed in the refrigerant pipe is a plurality of helical grooves.

* * * * *